United States Patent [19]

Imahashi

[11] Patent Number: 4,459,780

[45] Date of Patent: Jul. 17, 1984

[54] CABOCHON COPY GRINDING APPARATUS

[76] Inventor: Takahiro Imahashi, 3-21-25, Higashi, Motomachi, Kokubunji City, Tokyo, Japan

[21] Appl. No.: 337,858

[22] Filed: Jan. 7, 1982

[30] Foreign Application Priority Data

Feb. 4, 1981 [JP] Japan ..... 56-15480

[51] Int. Cl.[3] ..... B24B 17/02

[52] U.S. Cl. ..... 51/101 R; 51/100 R; 51/165.87; 51/229

[58] Field of Search ..... 51/97 R, 100 R, 101 R, 51/101 LG, 121, 127, 165.87, 216 LP, 229, 283 R; 125/11 TP, 11 F

[56] References Cited

U.S. PATENT DOCUMENTS

| | | | |
|---|---|---|---|
| 134,296 | 12/1872 | Libbey | 51/100 R |
| 957,978 | 5/1910 | Meyers | 51/100 R |
| 1,386,080 | 8/1921 | Simmons | 51/100 R |
| 1,918,584 | 7/1933 | Behle | 51/100 R |
| 2,282,038 | 5/1942 | Davenport | 125/11 TP |
| 2,956,377 | 10/1960 | White | 51/100 R |
| 4,174,592 | 11/1979 | Bernhardt | 51/101 R |

*Primary Examiner*—Robert P. Olszewski

*Attorney, Agent, or Firm*—Wenderoth, Lind & Ponack

[57] ABSTRACT

A cabochon copy grinding apparatus comprises a flexible template of a variable curvature, a template supporting ring the template head head of an adjustable holding distance, a grinding wheel, a master cabochon attaching shaft, a workpiece attaching shaft, and an interlocking device for operatively connecting the master cabochon attaching shaft and the workpiece attaching shaft. The cabochon copy grinding apparatus can grind a workpiece such as a precious stone by copying a master cabochon as a model at a high fidelity.

3 Claims, 7 Drawing Figures

CABOCHON COPY GRINDING APPARATUS

BACKGROUND OF THE INVENTION

1. Field of the Invention

The present invention relates to a cabochon copy grinding apparatus and, more particularly, to an apparatus adapted to grinding a workpiece of a precious stone, a semi-precious stone, or the like material, copying the contour of a master cabochon serving as a model.

2. Description of the Prior Art

A cabochon is a precious stone of convex hemispherical or oval form, polished but not cut into facets.

Hitherto, various types of apparatus have been proposed for grinding a workpiece of a precious stone, semi-precious stone, or the like material. These known apparatus, however, are generally complicated, expensive and require a precision device for adjusting the angle and pressure of the contact of the workpiece with a grinding wheel. In addition, specific skill and experience are required for grinding the workpiece with these known apparatus.

SUMMARY OF THE INVENTION

Accordingly, an object of the invention is to provide a cabochon copy grinding apparatus having a single construction and being extremely easy to operate, thereby obviating the above-described problems of the prior art.

To this end, according to the invention, there is provided a cabochon copy grinding apparatus comprising: a template head fixed to a spindle bearing drum coaxial with a grinding wheel mounted rotatably, the mounting angle of the template head being adjustable; a template of a variable curvature; a frame rotatably mounted on a rod and provided at its lower portion with a bracket; a worm shaft rotatably mounted in the bracket and extending in parallel with the rod; a cabochon mounting shaft and a workpiece mounting shaft parallel with the worm shaft and rotate in the same direction as the worm shaft; and a motor and an interlocking device adapted to rotate the master cabochon and the workpiece in parallel with each other and in the same direction.

The above and other objects, features and advantages of the invention will become clear from the following description of the preferred embodiment taken in conjunction with the accompanying drawings.

DESCRIPTION OF THE PREFERRED EMBODIMENT

Figure 1:
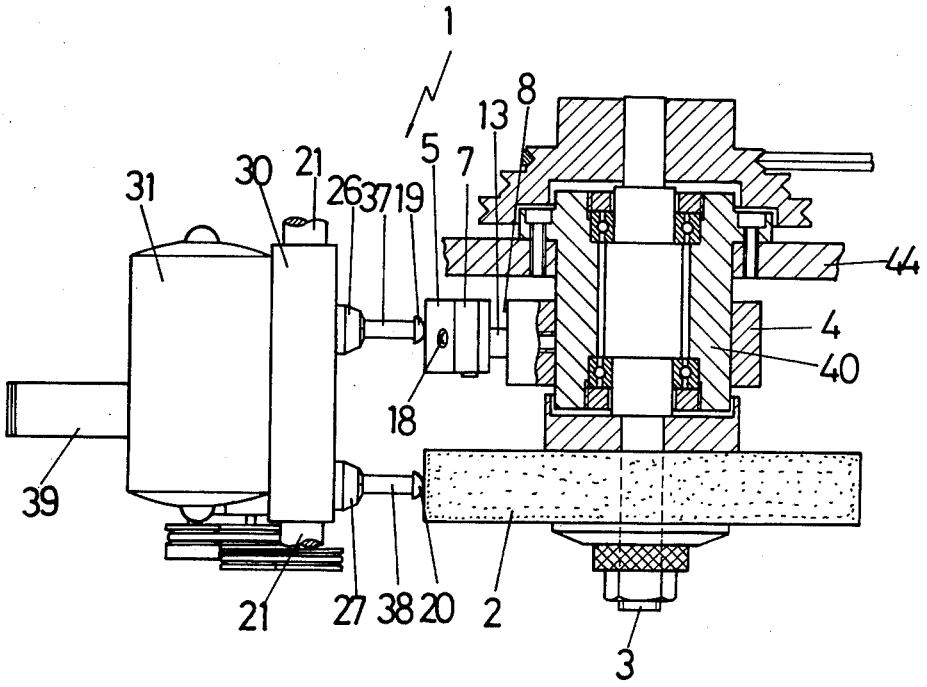
FIG. 1 is a schematic plan view of a cabochon copy grinding apparatus in accordance with an embodiment of the invention.
Figure 2:
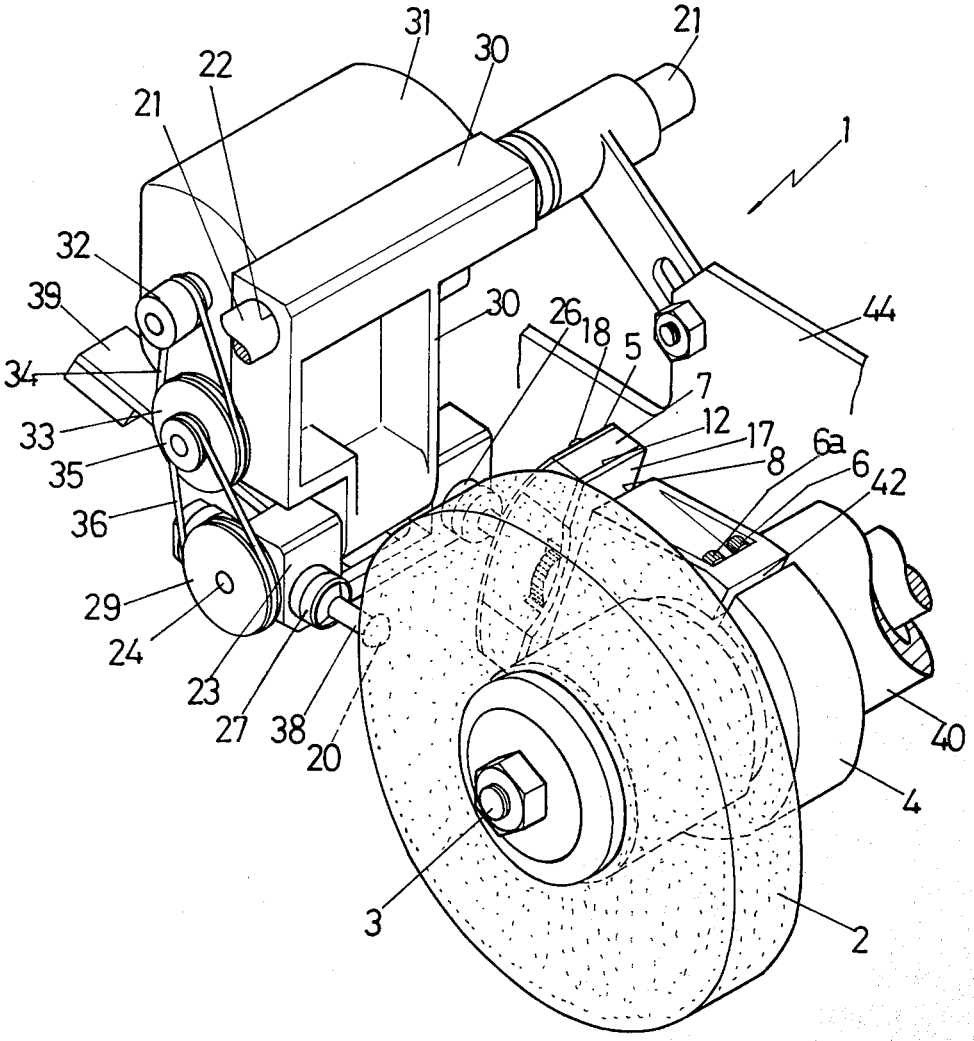
FIG. 2 is a schematic perspective view of the cabochon copy grinding apparatus shown in FIG. 1 with a part thereof being omitted.

Referring to FIGS. 1 and 2, a cabochon copy grinding apparatus in accordance with an embodiment of the invention, generally designated by a reference numeral 1, has a grinding wheel 2 fixed to a rotatable wheel spindle 3. The apparatus 1 further has a spindle bearing drum 40 fixed to a body case 44 coaxially with the wheel spindle 3, and a template head supporting ring 4 fitted around the spindle bearing drum 40. The template head supporting ring 4 is cut at an intermediate portion 42 thereof as will be seen from FIGS. 2, 3 and 4.

Figure 3:
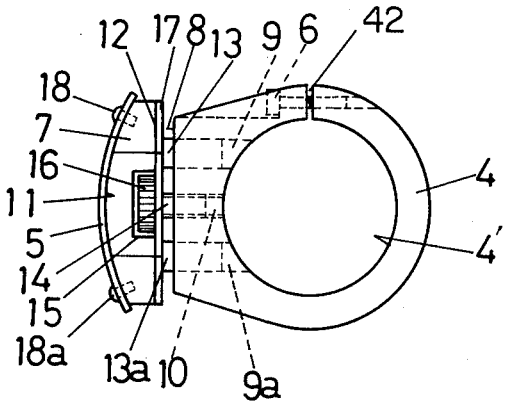
FIG. 3 is a front elevational view of a template mounted at the same curvature as the curvature of the template head.
Figure 4:
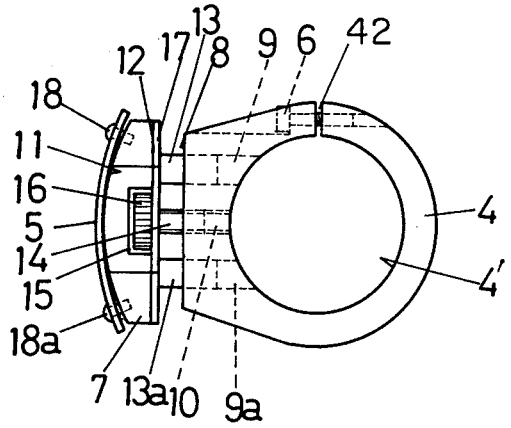
FIG. 4 is a front elevational view of a template mounted at a curvature greater than the curvature of the template head.

As shown in FIGS. 3 and 4, a template head 7 is fixed to a flattened outer surface 8 of the supporting ring 4 by means of a screw rod 14 screwed into a threaded bore 10 formed in the wall of the supporting ring 4.

For fitting the supporting ring 4 around the spindle bearing drum 40, the supporting ring 4 having a circular inner peripheral surface 41 is placed around the spindle bearing drum 40 having a circular outer peripheral surface, and fastening screws 6,6*a* attached to the cut intermediate portion 42 of the supporting ring 4 are tightened to make the supporting ring 4 tightly hold and embrace the spindle bearing drum 40. Thus, by loosening the fastening screws 6,6*a*, the supporting ring 4 around the spindle bearing drum 40 becomes loose and rotatable to permit an adjustment of the mounting angle as desired.

The template head 7 is provided with an outer surface 11 curved at a predetermined curvature. A template 5 is attached to this curved outer surface 11 by means of attaching screws 18,18*a*.

The template 5 is made of a resilient metallic plate bent at a curvature greater than the curvature of the curved outer surface 11 of the template head 7. It is, therefore, possible to adjust the curvature of the template 5 by adjusting the degree of tightening of the attaching screws 18,18*a*, between the curvature of the template head 7 and the original curvature of the template 5 itself in a linear manner.

The template head 7 has a flat inner surface 12 to which fixed are two guide pins 13,13*a* at a predetermined distance from each other. A groove 15 is formed at a portion of the flat inner surface 12 between two guide pins 13,13*a*. The groove 15 receives a dial portion 16 provided at one end of the screw rod 14. A closure plate 17 is attached to the flat inner surface 12 so as to oppose the flat outer surface 8 of the supporting ring 4, thereby preventing the dial portion 16 from moving in the axial direction.

The flattened outer surface 8 of the supporting ring 4 is provided with guide holes 9,9*a* extending at a right angle thereto and spaced by a predetermined distance from each other. The arrangement is such that the guide pins 13,13*a* are moved into and out of the guide holes 9,9*a* as the screw rod 14 is driven by the rotation of the dial portion 16 into the threaded bore 10 which is formed also in the flattened outer surface 8 of the supporting ring 4.

Therefore, as the dial portion 16 is rotated manually, the template head 7 is moved toward and away from the flattened surface 8 of the supporting ring 4, together with the template 5. In addition, since the mounting angle of the supporting ring 4 in relation to the spindle bearing drum 40 is adjustable, the curvature of the template 5, the span of support of the template 5 and the angle of support of the template 5 can be freely adjusted as required.

Figure 5:
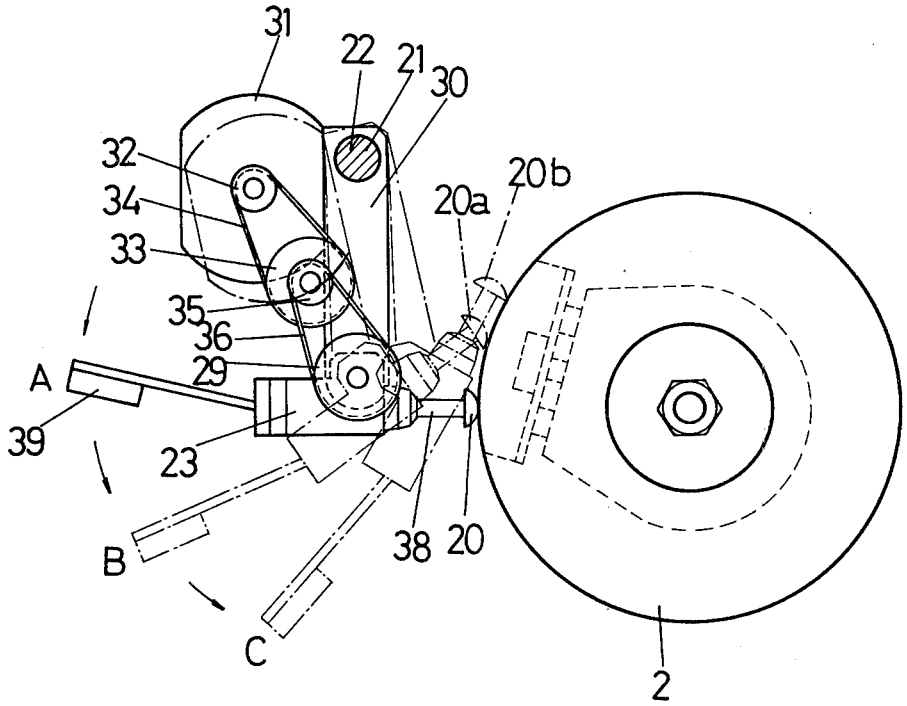
FIG. 5 is a schematic front elevational view showing the transition of the grinding angle of the workpiece in relation to the grinding surface of the grinding wheel.
Figure 6:
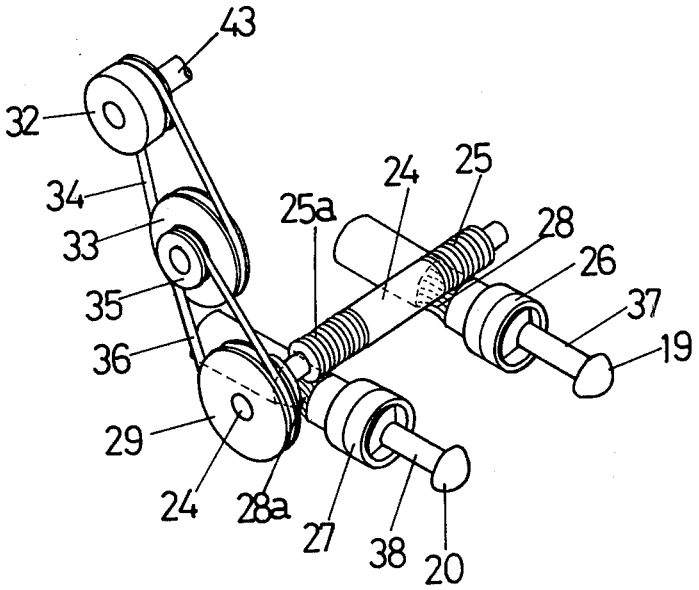
FIGS. 6 and 7 are schematic perspective views of an interlocking mechanism for operatively connecting a master cabochon and a workpiece.
Figure 7:
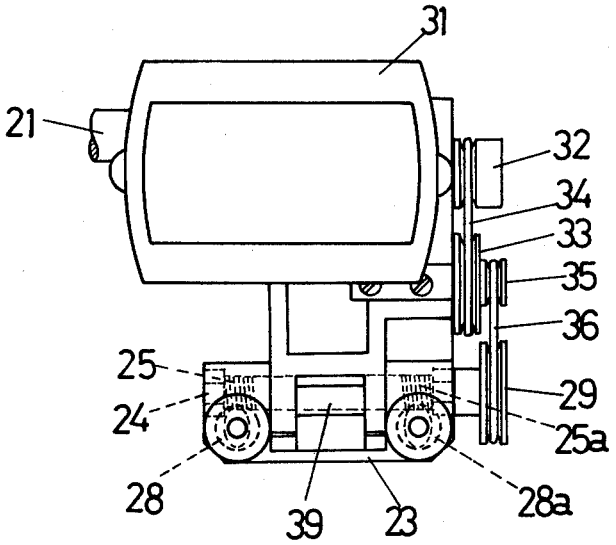

The frame 30 (See FIGS. 1,2 and 5) is provided at its upper portion with a hole 22 and at its lower portion with a bearing bracket 23. Also, a motor 31 is integrally attached to the rear portion of the frame 30. The hole 22 is adapted to receive a rod 21. The rod 21 is mounted on the body case 44 so as to extend in parallel with the wheel spindle 3 carrying the grinding wheel 2. The frame 30 is rotatable around the rod 21 serving as a rotation axis. As shown in FIGS. 6 and 7 a worm shaft 24 is rotatably mounted in the bracket 23 so as to extend in parallel with the rod 21. Furthermore, as best shown in FIG. 5, an operation lever 39 is attached to the outer side of the bracket 23 so as to extend outwardly therefrom at a right angle to the worm shaft 24 shown in FIG. 7. Two worms 25 and 25*a* are formed on the worm shaft 24, as shown in FIGS. 6 and 7. The bracket 23 rotatably carries a master cabochon attaching shaft 26 having a worm wheel 28 meshing with the worm 25 of the worm shaft 24. The bracket 23 (FIG. 7) rotatably carries also a workpiece attaching shaft 27 (FIG. 6) having a worm wheel 28*a* meshing with the worm 25*a* on the worm shaft 24. The master cabochon attaching shaft 26 and the workpiece attaching shaft 27 extend in parallel with each other, and the worms 25,25*a* and worm wheels 28,28*a* have an equal pitch.

As shown in FIG. 6, a master cabochon 19 is detachably attached to the master cabochon attaching shaft 26 through a master cabochon dop stick 37, while a workpiece 20 to be worked is detachably attached to the workpiece attaching shaft 27 through a dop stick 38.

The rotation of the rotor of the motor 31 (See FIGS. 2,5, 6 and 7) is transmitted to the master cabochon attaching shaft 26 and the workpiece attaching shaft 27 through an interlocking mechanism including a pulley 32 fixed to the motor shaft 43, belt 34, intermediate pulley 33, a small pulley 35 coaxial with the intermediate pulley 33, belt 36, pulley 29 worm shaft 24, worms 25,25*a*, and the worm wheels 28,28*a*. The master cabochon attaching shaft 26 and the workpiece attaching shaft 27 then drive the master cabochon 19 and the workpiece 20 through the dop sticks 37 and 38, respectively. Thus, the master cabochon 19 and the workpiece 20 are rotated at the same speed and around parallel axes.

The cabochon copy grinding apparatus 1 of the invention having the construction heretofore described operates in a manner explained hereinunder.

First of all, as shown in FIG. 1, the template supporting ring 4 is set around the spindle bearing drum 40, and the fastening screws 6,6*a* (FIG. 2) are tightened to fix the template head 7 at the desired mounting angle. Then, the dial portion 16 (FIGS. 3 and 4) is rotated to determine the amount of projection of the template head 7 and the attaching screws 18,18*a* are driven to set the template 5 at a desired curvature.

Then, the operation lever 39 (See FIG. 5) is manually pressed in the direction of the arrow A, so that the operation lever 39 is moved as indicated by arrows B and C. In consequence, a frame 30 is rotated around the rod 21 so that the position of the workpiece 20 in relation to the grinding wheel 2 is changed from the position shown by the full line to positions shown by chain lines and denoted at numerals 20*a* and 20*b*, thereby to changing the angle of contact between the workpiece 20 and the grinding wheel 2.

Similarly, as the operation lever 39 is lifted, the position of the workpiece 20 is shifted to a level below the center of the grinding wheel 2. It is thus possible to polish the entire surface of the workpiece 20 by the combination of the swinging motion caused by the manipulation of the operation lever 39 and the rotation of the dop stick 38. It is to be noted here that, since the master cabochon 19 and the workpiece 20 are rotated at the same speed and in the same direction through the worms 25,25*a* of the same diameter and pitch formed on a common worm shaft 24 and worm wheels 28,28*a* meshing with these worms 25,25*a*, the workpiece 20 is polished into the same configuration as the master cabochon 19.

In the actual use of the apparatus, at first the template 5 (FIGS. 1–4) is set for a coarse grinding such that the outer surface 11 thereof projects slightly outwardly of the outer peripheral surface of the grinding wheel 2, and then the template 5 is set at the same projection amount and curvature as the grinding wheel 2 for finish polishing.

The template head (FIGS. 1–4) can be moved precisely as the dial portion 16 is rotated for adjusting the amount of projection of the template head 7, because the guide pins 13 and 13*a* are smoothly and correctly guided by the guide holes 9 and 9*a*, respectively.

As will be understood from the foregoing description, the cabochon copy grinding apparatus 1 of the invention makes it possible to polish and finish the entire surface of the workpiece 20 exactly and easily in conformity with the configuration of the master cabochon 19 serving as a model, by a partially manual operation. In addition, the grinding angle and the grinding pressure can be adjusted as desired by a simple manipulation of the operation lever 39, so that the workpiece 20 can be polished even if the final shape of the workpiece 20 has a complicated curved surface. Furthermore, since the curvature of the template 5 can be varied to compensate for the wear and reduction of diameter of the grinding wheel 2, the workpiece 20 can be shaped following up the configuration of the master cabochon 19 at a high fidelity.

As has been described, the present invention provides a cabochon copy grinding apparatus 1 having novel and advantageous features over the conventional apparatus.

Although the invention has been described through specific terms, it is to be noted here that the described embodiment is not exclusive and various changes and modifications may be imparted thereto without departing from the spirit and scope of the invention which is limited solely by the appended claims.

What is claimed is:

1. A cabochon copy grinding apparatus comprising:

a rotatable spindle;

a spindle bearing drum aligned coaxially with the rotatable spindle;

a grinding wheel being fixed to the rotatable spindle and having an outer periphery;

a template supporting ring being fixed to the spindle bearing drum and having a mounting angle adjustable in relation thereto;

a template head adjustably supported on the template supporting ring;

a flexible template being adjustable attached to the template head and having a variable outer curvature;

means for adjustably attaching the flexible template to the template head so that the curvature of the flexible template can be adjusted to match the outer periphery of the grinding wheel as the periphery of the grinding wheel changes due to wear;

a cabochon attaching shaft and a workpiece attaching shaft extending in parallel with each other;

a master cabochon being detachably secured to the cabochon attaching shaft and contacting the variable outer curvature of the flexible template;

a workpiece holder being secured to the workpiece attaching shaft and bringing a workpiece into contact with the outer periphery of the grinding wheel;

an interlocking means for simultaneously rotating the master cabochon and the workpiece; and a manual lever means, connected to the interlocking means, for changing the position of the master cabochon in relation to the variable outer curvature of the flexible template and for simultaneously changing the position of the workpiece in relation to the outer periphery of the grinding wheel;

whereby the workpiece is polished into the same configuration as the master cabochon.

2. The cabochon copy grinding apparatus, according to claim 1, further comprising:

means, arranged intermediately in the template supporting ring, for adjusting the mounting angle of the template supporting ring in relation to the spindle bearing drum.

3. The cabochon copy grinding apparatus, according to claim 1, further comprising:

rotatable dial means, arranged in the template head, for adjustably moving the template head toward and away from the template supporting ring.

* * * * *